US005876360A

United States Patent [19]

Liu

[11] Patent Number: 5,876,360

[45] Date of Patent: Mar. 2, 1999

[54] METHOD OF TREATING DISEASE WITH SHOCK AIR

[76] Inventor: Jianhong Liu, 58 Tonghui St., Jinan Shandong, China, 250001

[21] Appl. No.: 628,365

[22] Filed: Apr. 5, 1996

[30] Foreign Application Priority Data

Dec. 21, 1995 [CN] China ..... 95 1 20462.9

[51] Int. Cl.[6] ..... A61H 9/00

[52] U.S. Cl. ..... 601/154; 601/155; 601/160; 128/898; 606/204

[58] Field of Search ..... 601/107, 134, 601/154, 155, 156, 160; 604/68; 128/898; 606/204

[56] References Cited

U.S. PATENT DOCUMENTS

| | | | |
|---|---|---|---|
| 3,467,081 | 9/1969 | Glass | 601/148 |
| 3,527,212 | 9/1970 | Clark | 604/68 |
| 5,044,357 | 9/1991 | Johns | 601/148 |

*Primary Examiner*—Richard J. Apley
*Assistant Examiner*—Benjamin Koo
*Attorney, Agent, or Firm*—Townsend and Townsend and Crew LLP

[57] ABSTRACT

The present invention relates to a method of treating diseases with shock air, including treating hypertension, cholecystitis, and other diseases by directing shock air to specific positions of human body at a frequency of up to and beyond about 3,000 times per minute.

6 Claims, No Drawings

METHOD OF TREATING DISEASE WITH SHOCK AIR

FIELD OF THE INVENTION

The present invention relates to methods of treating diseases, especially to the method of treating diseases with intermittent shock air of short time duration.

BACKGROUND OF THE INVENTION

In Chinese traditional medicine, massage is a common method of treating diseases, e.g. single thumb massage. Because massage is a non-medicinal therapy, it is harmless and painless to the human body, and therefore it has no side effect. The single thumb massage with the end of the thumb working on certain positions with the frequency of 120–160 times per minute can improve the blood circulation of the human body for curing or treating diseases. According to the methods of the invention, the thumb used in single thumb massage is replaced by shock air. Not only is the human resource saved, but the treating effect is improved greatly because of the high frequency of over 160 times per minute of the shock air (even as high as 3000 times per minute). Therefore it is a great breakthrough over the prior art.

SUMMARY OF THE INVENTION

The invention involves methods of treating diseases, especially those working on specific positions (acupoints) of the human body with shock air. The shock air may be produced by the treating instrument described in patent No. PCT/CN95/0060, filed by the inventor on Jul. 12, 1995. The frequency of the shock air produced by the instrument can be as high as 3000 times per minute.

DETAILED DESCRIPTION OF THE PREFERRED EMBODIMENTS

The treating method of the invention is to stimulate some positions (acupoints) of the human body with high-frequency shock air for curing or treating diseases. Specifically, the positions stimulated by the shock air include some specific positions below the elbow and finger and between the ankle and toe. Examples of the specific positions are Neiguan, Waiguan, Houxi, Hegu, Yuji, Shenmai, Zulinqi, Zhaihai, Gongsun, Taichong, Jiexi, etc. Stimulating different acupoints can treat different diseases. For example, stimulating the acupoints such as Neiguan, Waiguan, Hegu and Gongsun can treat hypertension. After treatment, systolic pressure can be lowered by about 10–30 mmHg and diastolic pressure about 5–10 mmHg. Stimulating Yuji, Waiguan, Jiexi, Shenmai and other acupoints can treat rhinitis, bronchitis and asthma.

Usually, four positions according to the present invention are selected for the treatment with shock air. But the present technique is not limited to these applications, and fewer or more than four positions can be selected if necessary.

The specific operation steps of the treating method of the invention are as follows: One end of each of several soft tubes is connected (e.g. sealed hermetically) with the air box of the air pump. The other ends of the soft tubes are connected with the treating end, and then the treating end is placed on specific locations on the human body with some fixing materials such as adhesive buttons. The shock air produced by the air pump may apply pressure on the specific positions.

The term "shock air" in the invention refers to intermittent air flow herein, generally with short time duration and regular frequency. Usually the frequency of the air is 160–3000 times per minute, and it may also be more than 3000 times per minute, to produce slight vibration.

The terms "Neiguan, Waiguan" and other acupoints in the invention are well-known to those skilled in the art. Specific positions refer to the following:

- Yuji: on the midst of the side of the first metacarpal bone, where the dorsoventral boundary of the hand is;
- Neiguan: 2 cun above the midst of the transverse crease of the wrist, between the tendons of m. palmaris longus and m. flexor radialis;
- Waiguan: 2 cun above the midst of the transverse crease of the back wrist, between the two bones;
- Hegu: on the dorsum of the hand, between the first and second metacarpal bones, approximately in the middle of the second metacarpal bone on the radial side;
- Houxi: when a loose fist is made, the point is on the ulnae side, proximal to the fifth metacarpophageal joint, at the end of the transverse crease;
- Gongsun: in the depression distal and inferior to the base of the first metatarsal bone, where the dorsoventral boundary of the foot is;
- Zhaihai: 1 cun below the medial malleolus;
- Jiexi: on the dorsum of the foot, at the midst of the transverse crease of the ankle joint, in the depression below the tendons of m. extensor digitorum longus and hallucis longus, approximately at the level of the tip of the external malleolus;
- Shenmai: in the depression directly below the external malleolous (half cun below it);
- Zulinqi: in the depression distal to the junction of the fourth and fifth metatarsal bones, on the lateral side of the tendon of m. extensor digiti minimi of the foot;
- Taichong: on the dorsum of the foot, in the depression distal to the junction of the first and second metatarsal bones.

In the invention, the term "cun" means the width of the first interphalangeal joint of the patient's thumb.

The treating time used in the method of the invention varies within 5 to 30 minutes with different ages, physiques and diseases of patients.

According to the method of the invention, various diseases involving those of the nervous system, locomotor system, respiratory system, urinary system, cardiovascular and cerebrovascular systems, and digestive system may be treated. In particular, the method of the invention has a unique effect on hypertension, cholecystitis, nervous headache, acute lumbar sprain, chronic rhinitis, chronic bronchitis, bronchial asthma, bronchitis, jaded appetite of children, etc.

EXAMPLE 1

The treating ends were connected with adhesive buttons on the following four acupoints: Neiguan, waiguan, Hegu and Gongsun of the hypertension patients, whose systolic pressure was 210 mmHg and diastolic pressure 120 mmHg. The power of the air pump was turned on to direct the shock air onto the specific locations on the human body with the frequency of 3000 times per minute. After treating for 3 to 10 minutes, and then waiting for 30 minutes, the treatment result measured was 180 mmHg systolic pressure and 110 mmHg diastolic pressure.

EXAMPLE 2

The treating ends were connected with adhesive buttons on the following four acupoints: Zulinqi, Taichong, Shenmai and Waiguan of the cholecystitis patient. The patient then was treated for 30 minutes with the shock air described in Example 1, once a day. The patient was cured after 3 days of the treatment.

EXAMPLE 3

The treating ends were connected with adhesive buttons on the following four acupoints of the chronic rhinitis patient: Yuji, Waiguan, Jiexi and Shenmai. The patient then was treated for 25 minutes with the shock air described in Example 1, once a day. The patient was nearly cured after 20 days of treatment.

What is claimed is:

1. A method of treating disease of a patient with at least one tube having an inlet end connected to a shock air source and an outlet end connected to a treating end member, the method comprising the steps of connecting the treating end member to a location on the patient by applying an adhesive button on the treating end member and the location on the patient; generating pulses of pressurized air in rapid succession to produce intermittent short bursts of air; and directing the intermittent short bursts of air having a preset frequency from the shock air source through the at least one tube and the treating end member to the location for a period of time.

2. A method of treating disease of a patient with at least one tube having an inlet end connected to a shock air source and an outlet end connected to a treating end member, the method comprising the steps of connecting the treating end member to an acupoint of the patient; generating pulses of pressurized air in rapid succession to produce intermittent short bursts of air; and directing the intermittent short bursts of air having a preset frequency from the shock air source through the at least one tube and the treating end member to the location for a period of time.

3. A method of treating disease of a patient with at least one tube having an inlet end connected to a shock air source and an outlet end connected to a treating end member, the method comprising the steps of connecting the treating end member to a location on the patient between an elbow and a finger or between an ankle and a toe of the patient; generating pulses of pressurized air in rapid succession to produce intermittent short bursts of air; and directing the intermittent short bursts of air having a preset frequency from the shock air source through the at least one tube and the treating end member to the location for a period of time.

4. A method of treating disease of a patient with a plurality of tubes having inlet ends connected to a shock air source and outlet ends connected to treating end members, the method comprising the steps of connecting the treating end members to a plurality of locations on the patient by connecting treating end members of four of the tubes to four acupoints including Neiguan, Waiguan, Hegu, and Gongsun on the patient having hypertension; generating pulses of pressurized air in rapid succession to produce intermittent short bursts of air; and directing the intermittent short bursts of air having a preset frequency from the shock air source through the plurality of tubes and the treating end members to the locations for a period of time.

5. A method of treating disease of a patient with a plurality of tubes having inlet ends connected to a shock air source and outlet ends connected to treating end members, the method comprising the steps of connecting the treating end members to a plurality of locations on the patient by connecting treating end members of four of the tubes to four acupoints including Zulinqi, Taichong, Shenmai, and Waiguan on the patient having cholecystitis; generating pulses of pressurized air in rapid succession to produce intermittent short bursts of air; and directing the intermittent short bursts of air having a preset frequency from the shock air source through the plurality of tubes and the treating end members to the locations for a period of time.

6. A method of treating disease of a patient with a plurality of tubes having inlet ends connected to a shock air source and outlet ends connected to treating end members, the method comprising the steps of connecting the treating end members to a plurality of locations on the patient by connecting treating end members of four of the tubes to four acupoints including Yuji, Waiguan, Jiexi, and Shenmai on the patient having chronic rhinitis; generating pulses of pressurized air in rapid succession to produce intermittent short bursts of air; and directing the intermittent short bursts of air having a preset frequency from the shock air source through the plurality of tubes and the treating end members to the locations for a period of time.

* * * * *